US005509364A

United States Patent [19]

Bardsley

[11] Patent Number: 5,509,364

[45] Date of Patent: Apr. 23, 1996

[54] CUT/LOOP MODULE FOR TUFTING MACHINES

[76] Inventor: Harold B. Bardsley, Near Chorley, United Kingdom

[73] Assignee: Spencer Wright Industries, Inc., Dalton Ga.

[21] Appl. No.: 305,020

[22] Filed: Sep. 13, 1994

[30] Foreign Application Priority Data

Jun. 17, 1994 [GB] United Kingdom ..... 9412208

[51] Int. Cl.[6] ..... D05C 15/22

[52] U.S. Cl. ..... 112/80.51; 112/80.55

[58] Field of Search ..... 112/80.5, 80.01, 112/80.51, 80.52, 80.53, 80.55, 80.56, 80.45; 164/98, 100, 69.1

[56] References Cited

U.S. PATENT DOCUMENTS

| | | | |
|---|---|---|---|
| 4,241,675 | 12/1980 | Bardsley | 112/80.51 |
| 4,241,676 | 12/1980 | Parsons et al. | 112/80.51 |
| 4,491,078 | 1/1985 | Ingram | 112/80.5 X |
| 4,522,132 | 6/1985 | Slattery | 112/80.51 |
| 4,739,717 | 4/1988 | Bardsley | 112/80.5 |

*Primary Examiner*—Paul C. Lewis
*Attorney, Agent, or Firm*—Alan Ruderman

[57] ABSTRACT

A cut/loop hook and clip module for use in a tufting machine has a molded body member including a plurality of tufting machine hooks cast therein in side-by-side relationship. The hooks have a beak at one end, a blade extending from the beak to a shank and a mounting portion of the shank extending remote from the beak. An elongated groove is formed in the shank and the mounting portion for receiving the tail portion of a cooperating clip. The clip includes a creased and bowed flag portion at one end of the tail portion. The hook includes a detent in the form of a notch adjacent the groove and the tail portion includes a detent in the form of a nub which is positionable into the notch to locate the clip so that the creased flag portion is in proper relationship relative to the beak of the hook. The flag portion of the clip is positioned on the side of the hook opposite to that having the groove with the flag portion biased against the blade adjacent the end of the beak. If a clip is damaged, it may be removed from the module and replaced by a new clip.

8 Claims, 1 Drawing Sheet

CUT/LOOP MODULE FOR TUFTING MACHINES

BACKGROUND OF THE INVENTION

This invention relates to tufting machines and more particularly to a cut/loop hook module having removable spring clips therein.

In a tufting machine a multiplicity of yarn carrying needles penetrate a backing material to insert loops of yarn therein which loops are seized and either thereafter shed by a looper to produce loop pile or are maintained on a hook and thereafter cut by a knife to produce cut pile. When loop and cut pile are to be produced in the same row of stitching a spring clip is secured to each cut pile hook and biased against the bill of the hook and the yarn fed to the needles is controlled so that on selective stitches less yarn is fed to a selective needle to backdraw yarn from a previous loop to cause that loop to force the spring clip away from the bill of the hook and be withdrawn from the hook to form an uncut loop. When sufficient yarn is fed to the needle, no yarn is backdrawn from the previous loop and the loop remains on the hook to be cut subsequently by a knife, as disclosed in Card U.S. Pat. No. 3,084,645.

As the gauge of tufted products have decreased, i.e., the spacing between adjacent rows of stitches and thus between respective needles and loopers or hooks, modules have been developed wherein the shanks of respective loopers or hooks are embedded in a common body in side-by-side disposition. Such constructions are illustrated in Bardsley U.S. Pat. Nos. 4,303,024 and 4,739,717. This modular construction substantially eliminates the difficulties of aligning hooks or loopers in a respective hook or looper bar of the tufting machine since the hooks or loopers are aligned in a jig during the formation of the module. Moreover, to produce cut/loop Bardsley U.S. Pat. No. 4,241,675 developed a module in which the hooks are mounted in a first body member and the clips are mounted in a second body member, the body members being adapted and arranged to locate the hooks and clips in the required cooperative relationship.

One difficulty with the modular construction is that of replacability of a broken gauge part, i.e., a hook, looper or clip. If a gauge part breaks the entire module must be removed and replaced, the module including the unbroken gauge parts generally being discarded or returned for remanufacture. In cut/loop apparatus, the clip is particularly vulnerable to damage, and it is usually the case in practice that damage to a particular clip results also in damage to adjacent clips. Since the cost of a clip component is but a relatively small portion of the total cost of a hook/clip combination, the need to discard such a combination, or indeed a plurality thereof in the case of non-modular hook/clip combinations because of damage to or failure of a single clip represents a financial burden out of all proportion to the fault. In Slattery U.S. Pat. No. 4,522,132 the spring clip of a cut/loop hook may be removed and replaced from the hook rapidly by providing cooperating male and female fastening means for positioning and aligning and thus removably attaching the clip to the hook. Even in this situation, if a number of clips are damaged, the down-time required for removing and replacing a number of clips may be all out of proportion to the damage. Thus, modular construction is desirable.

In the utilization of hook/clip combinations to produce cut/loop fabric, yarn tension and component precision effect the quality of the goods produced. If improper and inconsistent tension of the clips against the hooks is present, the resultant product is reflective of this difficulty. Control of these factors becomes significantly more important as the gauge of the tufting machine is reduced. Moreover, the free movement of the parts and interference therebetween clearly creates difficulties when the spacing between adjacent clips and hooks is relatively close. Thus, it is highly desirable to use modules for mounting the hooks and clips in the proper relationship. For these reasons modular cut/loop hooks having the hooks and clips permanently secured within the modular body have been utilized. Only the aforesaid Bardsley U.S. Pat. No. 4,241,675 developed an arrangement wherein broken clips, albeit as a separate modular unit, may be removed from hook modules.

SUMMARY OF THE INVENTION

Consequently, it is a primary object of the present invention to provide a cut/loop hook module for a tufting machine wherein spring clips may be removed and replaced individually from the module.

It is another object of the present invention to provide a cut/loop hook module for a tufting machine in which the spring clip is firmly mounted and aligned accurately on the hook within the module but removable therefrom.

It is a further object of the present invention to provide a replaceable spring clip for a cut/loop hook module, the hook having a clip receiving groove in the shank and the clip and hook having cooperating detent means for positioning the clip relative to the hook, the spring portion of the clip being biased against the beak of the hook on the side of the hook opposite to that having the groove.

Accordingly, the present invention provides a cut/loop hook module within which the mounting portion of the shanks of a plurality of hooks are fixed in the body of the module with the beaks of the hooks extending away from the module, the module being adapted for attachment to a tufting machine, each hook cooperating with a spring clip for use in manufacturing cut/loop tufted products. The shank of each hook includes an elongated groove which extends into the module body, the groove being of a depth into the hook substantially equal to the thickness of the clip. The shank of the hook includes a detent in the form of a notch adjacent the groove. The spring clip comprises a creased and bowed flag portion or spring upstanding at the end of an elongated tail portion, the tail portion being received within the groove. The tail portion includes a detent in the form of a nub which is positionable into the notch to locate the clip in operative position relative to the hook so that the creased flag portion may be located at the proper position relative to the beak of the hook, the flag being positioned on the side of the hook opposite to that having the groove with the outwardly bowed portion of the crease normally abutting the hook adjacent the end of the beak.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
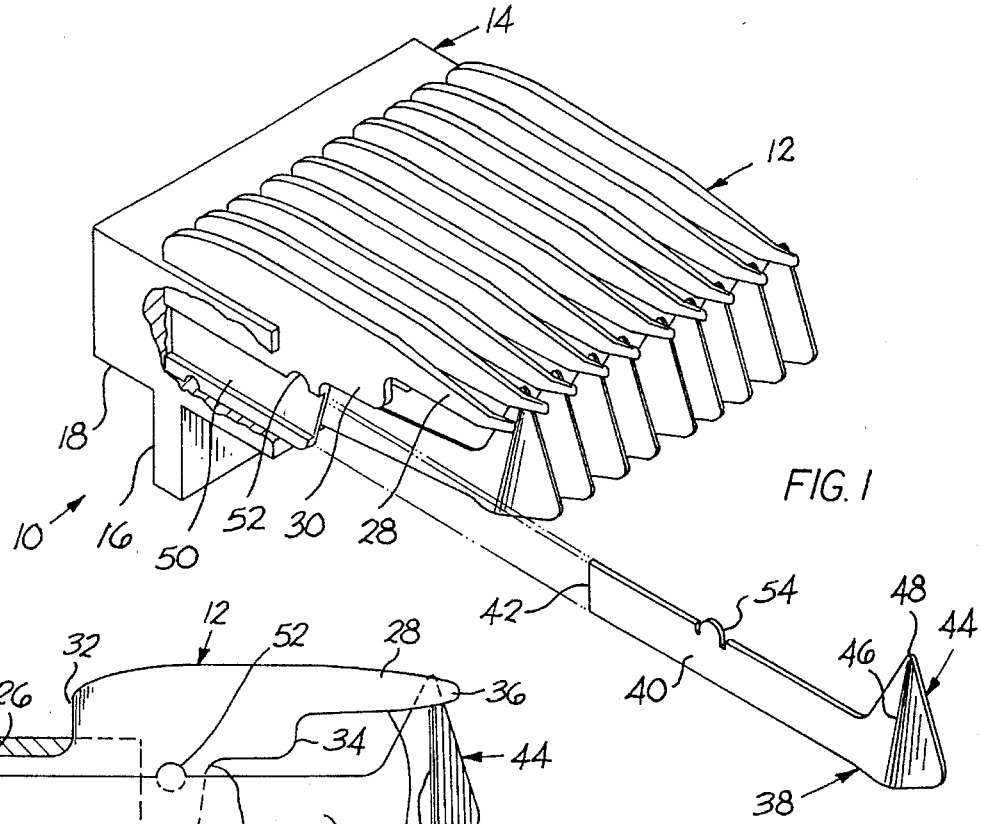
FIG. 1 is a perspective view of a cut/loop hook module with portions of the module broken away and with one of the spring clips exploded out of the module.

Referring now to the drawings, a module 10 incorporating the principles of the present invention comprises a plurality of hooks 12 cast integrally in spaced side-by-side relationship within a common body 14. The body 14 has a datum surface 16 including a lip 18 for engagement with a hook bar (not shown) and is secured to such bar by a bolt or the like which extends through a hole 20. The hooks are disposed in aligned relationship for cooperating with respective needles in the tufting machine and extend outwardly from the body 14.

Figure 2:
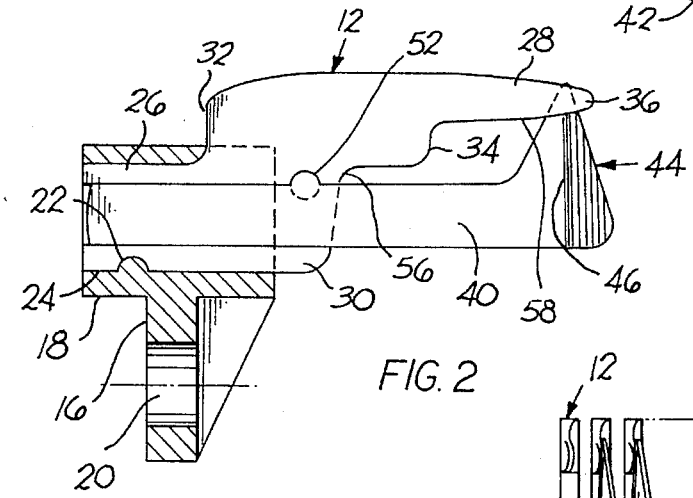
FIG. 2 is a cross sectional view taken through the module illustrating a hook and a clip.
Figure 3:
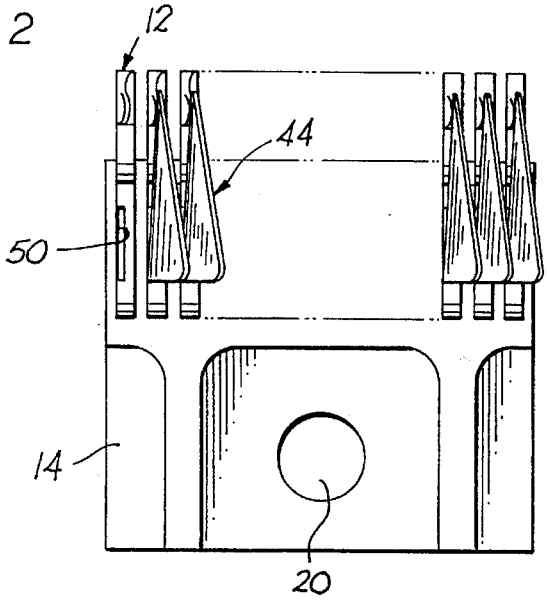
FIG. 3 is a front perspective view of the module.
Figure 4:
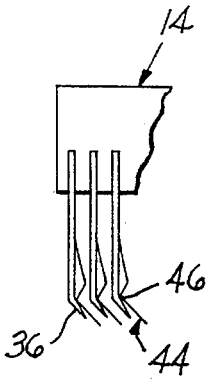
FIG. 4 is a fragmentary top plan view of the module.

The hooks 12, which typically as well known in the art are formed from alloyed steel having adequate strength and hardness for use in the context of a tufting machine include a semi-circular or similar recessed detent 22 as illustrated in FIG. 2, formed at a longitudinal edge, such as the lower edge 24 of the mounting portion 26 of the hook to retain the same in position within the body member 14. The hooks are disposed in a jig and the body member is cast about the hooks from a material which is commonly used in the art, such as a low melting point alloy of zinc/lead/aluminum, the detent 22 acting to ensure that the hooks are seucred within the body member.

Each hook 12 is a substantially planar member having a body portion comprising a blade 28 and a shank 30, the shank including the mounting portion 26 extending rearwardly relative to the blade. The rear edge of the blade 28 forms a neck 32 which extends downwardly to the top edge of the mounting portion 26. The blade 28 extends forwardly from the shank and defines the throat 34 at the forward end at the junction of the shank and the blade. The blade thus extends from the throat and terminates at the forward end in a point or beak 36, the beak being bent slightly out of the plane of the blade in the preferred embodiment.

The spring clip 38 comprises a narrow resilient strip of spring steel including a substantially straight tail portion 40 which extends in elongated fashion and when mounted as hereinafter described is substantially parallel to and spaced below the blade 28 of the hook. The tail portion is a substantially planar body extending from a tail end 42 to an enlarged and substantially triangular or flag portion 44, there being a crease 46 in the flag portion having an outwardly bowed side for engaging the hook adjacent to the beak 36 when the spring clip is in the operative position as hereinafter described. The portion 44 flares away from the crease at each side thereof to form an outward and inward bow so that only the crease 46, particularly the outwardly bowed side, engages the hook, the engagement being adjacent the apex 48 of the flag portion. Additionally, as known in the art, the flag portion 44 extends away from the hook engaging apex at an angle for engaging and guiding a corresponding needle of the tufting machine between the blade 28 and the clip as the hook moves to seize a loop, the loop either remaining on the hook or being pulled past the crease 46 of the flag 44 to selectively produce either a cut or uncut loop.

As aforesaid, in the prior art cut loop modules having the spring clips permanently mounted within the body of the module in a manner similar to the hooks are known. The tail portion of the clip and the flag portion in such modules, as in the conventional non-modular constructions are at the same side of the hook. The present invention is related to the attachment of the clip 38 to the module and a respective hook while providing removability of the spring clip for easy repair, replacement or otherwise. This is achieved by providing in the shank 30 of the hook 12 an elongated groove 50 on one side of the hook extending into the module. When the module is formed by casting material about the mounting portions of the hooks, a readily removable insert is positioned within the groove so that the material from which the body member of the module is cast does not fill the groove. The groove 50 is of a width and depth for receiving the mounting portion of the tail portion 40 of the spring clip so that the tail portion forms a substantially planar continuation of the surface of the hook above and below the groove. The tail portion of the spring clip may thus be inserted or removed from the groove between the surface of the groove 50 and the slot defined by the spacing of that surface with the adjacent portion of the module.

In order to position the clip within the slot so that the crease 46 is properly located relative to the beak 36 of the hook, detent means are provided on the spring clip and the hook which cooperate to properly locate the clip. In the preferred form of the invention the detent means comprises a notch 52 on the edge of the groove 50 in the shank 30 of the hook. The notch 52 preferably comprises a semi-circular portion of a circular hole bored through each of the hooks, while the spring clip has a corresponding nub 54 in the form of a substantially semi-circular configuration for receipt within the notch 52. The tail portion 40 of the spring clip may slidably be positioned within the groove 50 of the hook until the nub 54 engages the leading edge 56 of the shank 30, and thereafter the clip may be flexed out of the plane of the hook while still sliding the tail portion rearwardly in the groove until the nub 54 is seated in the recess 52. At that point the spring clip is positioned longitudinally in the correct disposition. Thereafter in view of the flexibility of the clip, the flag portion 44 of the spring clip is twisted so that the apex 48 is moved from the side of the hook in which the groove is formed to below the lower edge 58 of the blade 28 and moved toward the opposite side of the hook. When released, the outwardly bowed side of the crease 46 adjacent the apex 48 is biased by the spring action to abut against the side of the hook opposite to the side in which the groove 50 is formed.

In operation, when a needle of the tufting machine engages the flag portion of the spring Clip and moves the bowed portion away from the hook so that the hook may seize a loop, the clip is not dislodged from the module due to the fact that the flag portion 44 is at the opposite side of the hook from the groove 50. Thus, the disposition of the flag portion of the clip on the opposite side of the hook from the groove ensures against inadvertent dislodgment of the spring clip from the module. When it is desired to replace a spring clip, one merely needs to flex the spring clip so that the apex 48 moves beneath the lower edge 58 of the blade 28 to the side of the hook in which the groove is disposed and thereafter to flex the spring clip to dislodge the nub 54 from the recess 52 so that the tail portion of the spring clip may be slidably removed from the groove 50.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A cut/loop hook and clip module for a tufting machine comprising a cast metal body, a plurality of tufting machine hooks, each hook comprising a substantially planar body member including a blade and a shank, said blade extending forwardly from the shank and terminating at a loop seizing beak, an elongated mounting portion having a pair of planar surfaces extending rearwardly from the shank, said mounting portions being permanently mounted in said body member so as to be fixed therein in spaced side-by-side disposition, an elongated groove formed in one planar surface of said mounting portion on one side of each hook and spaced from said body member adjacent said one side, said clip comprising an elongated member having a substantially planar tail portion having first and second planar surfaces, said tail portion having an upwardly extending enlargement at one end and a free end remote from said enlargement, at least a part of said tail portion including said free end being of a width and thickness removably receivable within said groove with the first surface of said part for forming a continuation of said one surface of said mounting portion and with the second surface abutting said body member adjacent said one side, cooperating detent means formed on said mounting portion and on said tail portion for locating said enlargement relative to said beak, and said enlargement being disposed resiliently against said blade on the opposite side of said hook from said one side.

2. A module as recited in claim 1, wherein said cooperating detent means comprises a male formation on one of said mounting portion and said tail portion and a female formation formed on the other of said mounting portion and said tail portion.

3. A module as recited in claim 1, wherein said detent means comprises a notch formed in one of said mounting portion and said tail portion and a nub receivable within said notch formed on the other of said mounting portion and said tail portion.

4. A module as recited in claim 3, wherein said notch is in said mounting portion and said nub is on said clip.

5. A module as recited in claim 1, wherein said enlargement includes a crease extending transverse to the direction of elongation of said tail portion, said crease defining inwardly and outwardly bowed surfaces on said enlargement, the outwardly bowed surface of said crease abutting said blade.

6. A module as recited in claim 5, wherein said cooperating detent means comprises a male formation on one of said mounting portion and said tail portion and a female formation formed on the other of said mounting portion and said tail portion.

7. A module as recited in claim 5, wherein said detent means comprises a notch formed in one of said mounting portion and said tail portion and a nub receivable within said notch formed on the other of said mounting portion and said tail portion.

8. A module as recited in claim 7, wherein said notch is in said mounting portion and said nub is on said clip.

* * * * *